US005603355A

United States Patent [19]

Miyazoe et al.

[11] Patent Number: 5,603,355

[45] Date of Patent: Feb. 18, 1997

[54] PILOT TYPE ELECTROMAGNETIC VALVE

[75] Inventors: Shinji Miyazoe; Makoto Ishikawa, both of Yawara-mura, Japan

[73] Assignee: SMC Corporation, Tokyo, Japan

[21] Appl. No.: 433,024

[22] Filed: May 3, 1995

[30] Foreign Application Priority Data

Jun. 17, 1994 [JP] Japan ..... 6-159259

[51] Int. Cl.[6] ..... F15B 13/043

[52] U.S. Cl. ..... 137/625.64; 251/30.01

[58] Field of Search ..... 137/625.64; 251/30.01; 439/700, 824

[56] References Cited

U.S. PATENT DOCUMENTS

| | | | |
|---|---|---|---|
| 3,290,636 | 12/1966 | Overtveld | 439/700 X |
| 4,387,739 | 6/1983 | Schaming et al. . | |
| 5,437,306 | 8/1995 | Asou et al. | 137/625.64 |
| 5,443,093 | 8/1995 | Stoll et al. | 137/625.64 X |

FOREIGN PATENT DOCUMENTS

| | | |
|---|---|---|
| 0231696 | 8/1987 | European Pat. Off. . |
| 0423899 | 4/1991 | European Pat. Off. . |
| 3917528 | 12/1990 | Germany . |
| 4309695 | 9/1994 | Germany . |

*Primary Examiner*—Gerald A. Michalsky

*Attorney, Agent, or Firm*—Oblon, Spivak, McClelland, Maier & Neustadt, P.C.

[57] ABSTRACT

A pilot type electromagnetic valve which has a pilot valve assembly accommodated in a pilot valve case which is mounted on a main valve assembly. Provided at one side of the pilot valve assembly are a pair of coil terminals, each of which has a conducting spring fitted thereon. On the other hand, a printed wiring board is attached to a terminal plate with current receiving terminals in such a way that a power supply circuit on the printed wiring board is electrically connected to the coil terminals through the conducting springs upon mounting the terminal plate on the pilot valve case.

2 Claims, 3 Drawing Sheets

PILOT TYPE ELECTROMAGNETIC VALVE

BACKGROUND OF THE INVENTION

1. Field of the Art

This invention relates to a pilot type electromagnetic valve with a simplified power supply assembly.

2. Prior Art

It would be acknowledged without any exemplification in particular that there is well known in the art the so-called pilot type electromagnetic valves which have, in combination with a main valve section with a main valve body for switching the flow direction of a main fluid, an electromagnetically operated pilot valve section for switching the position of the main valve body by the action of a pilot fluid pressure.

In the known pilot type electromagnetic valve of this sort, electric power is supplied to the pilot valve section through a printed wiring board which is mounted on a pilot valve assembly, the printed wiring board having electrical parts such as resistors, indicator lamps, a counter emf inhibitor and so forth assembled into a printed power supply circuit.

In this connection, it has been the usual practice to make electrical connections between the printed wiring board and the pilot valve section by way of a predetermined number of jack type terminals which are provided on the part of the printed wiring board, and pin type coil terminals projected from a solenoid coil in the pilot valve section for insertion into the jack terminals by press-in fitting engagement therewith. Therefore, upon inspection or replacement of the pilot valve section, each time there arises a necessity for unplugging and plugging the coil terminals from and into the jack terminals on the printed wiring board. These troublesome unplugging and plugging procedures are not only time-consuming but also very likely to cause bending deformations or breakage or other damages to the pin type coil terminals which are subjected to distorting or straining forces each time when they are unplugged and plugged in.

Besides, a certain type of electromagnetic valve is required to ground the pilot valve by way of a grounding terminal which is provided on the printed wiring board. In such a case, it is desirable to employ an arrangement which will permit one to connect the pilot valve section to the grounding terminal securely in a facilitated manner.

SUMMARY OF THE INVENTION

It is an object of the present invention to provide a pilot type electromagnetic valve with a power supply assembly which is arranged to facilitate electrical connections and disconnections of a printed wiring board of the power supply relative to a pilot valve section.

In an attempt to achieve the above-stated objective, the pilot type electromagnetic valve according to the present invention basically includes a main valve section having a main valve body within a main valve casing to switch the flow direction of a main fluid, an electromagnetically operated pilot valve section for switching the position of the main valve body by the action of a pilot fluid pressure, and a power supply for supplying current to the pilot valve section, characterized in that the pilot valve section includes a couple of coil terminals connected to a solenoid coil and accommodated in projected state within a pilot valve case mounted on the main valve section, and conducting springs mounted on the coil terminals as resilient contacts; and the power supply includes current receiving terminals mounted on a terminal plate adapted to serve also as a lid for the pilot valve case, and a printed wiring board supporting thereon an electrical power supply circuit and mounted on the terminal plate with the current receiving terminals and the power supply circuit in conductive state, the power supply circuit and coil terminals being electrically connected with each other through the conducting springs upon mounting the terminal plate on the pilot valve case.

In another preferred form of the invention, a grounding terminal is mounted on the terminal plate and the printed wiring board, and a grounding spring is fitted on the fore end of the grounding terminal in such a way that the grounding terminal is electrically connected to the pilot valve section through the grounding spring upon mounting the terminal plate on the pilot valve case.

With the above-described pilot type electromagnetic valve according to the invention, after mounting the pilot valve section within the pilot valve case at one end of the main valve section, the terminal plate which has the printed wiring board attached thereon is set in an opening in the pilot valve case, whereupon the conducting springs on the coil terminals are pressed against the power supply circuit on the printed wiring board to complete the electrical connections between the coil terminals and the power supply circuit for supplying current from the current receiving terminals to the pilot valve section through the printed wiring board.

In this instance, the coil terminals and the printed wiring board are connected with each other through the resiliently contacting actions of the conducting springs, so that there is no possibility of the coil terminals being subjected to distorting or straining forces at the time of mounting the terminal plate on the pilot valve case. Therefore, it becomes possible to prevent damage to the coil terminals which might be caused by repeated mounting and dismantling of the terminal plate.

Further, since the printed wiring board is mounted on the terminal plate instead of the pilot valve assembly, the pilot valve assembly can be mounted in an arbitrary manner with a greater freedom in structural designs exempt from the limitations which would be imposed in case the printed wiring board is mounted on the pilot valve assembly in the usual manner, coupled with an advantage that the maintenance and service of the pilot valve section becomes easier since the printed wiring board can be detached therefrom upon dismantling the terminal plate.

Moreover, as soon as the terminal plate is mounted on the pilot valve case, the grounding spring at the fore end of the grounding terminal on the terminal plate is pressed against a predetermined grounding structure of the pilot valve section, precluding the necessity of modifying the construction of the pilot valve section specifically for this purpose.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF PREFERRED EMBODIMENTS

Figure 1:
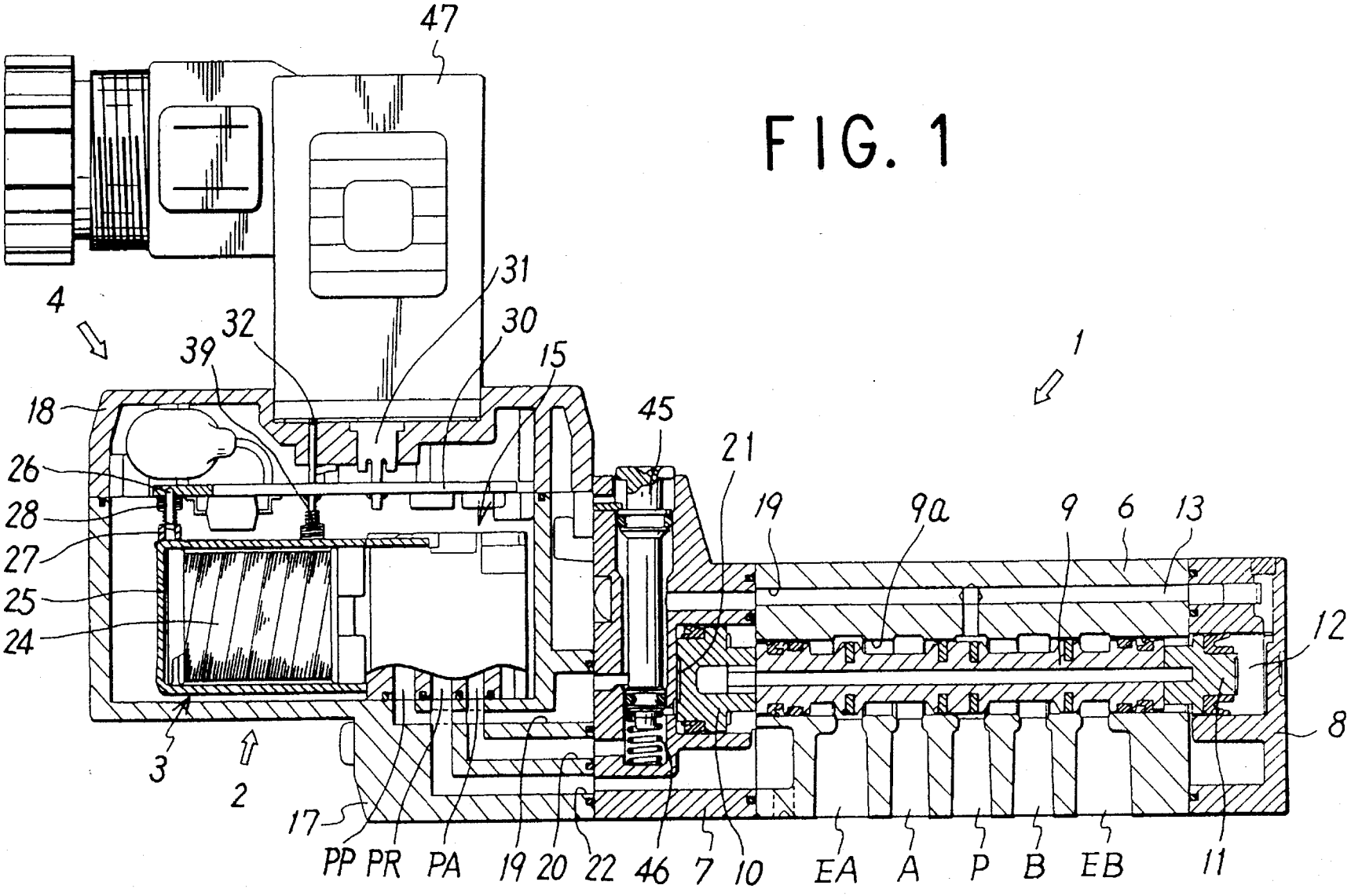
FIG. 1 is a longitudinal section of an embodiment of the pilot type electromagnetic valve according to the present invention.

Shown in FIG. 1 is an embodiment of the pilot type electromagnetic valve according to the invention, which is largely constituted by a main valve section 1 incorporating a main valve body 9 for switching the flow direction of a main fluid, an electromagnetically operated pilot valve section 2 for switching the position of the main valve body 9 by the action of a pilot fluid pressure, and a power supply section 4 for supplying current to a solenoid portion 3 of the pilot valve section 2.

The main valve section 1 includes a main valve casing 6 which is provided with an inlet port P for a pressurized fluid such as compressed air, output ports A and B, exhaust ports EA and EB, a valve bore 9*a* into which the respective ports are opened, and first and second piston cases 7 and 8 which are attached to the opposite ends of the valve casing 6 by suitable means.

A spool type main valve body 9 is slidably received in the valve bore 9*a* to establish or block communication of the inlet port P with the output ports A or B and at the same time to establish or block communications of the output ports A and B with the exhaust ports EA and EB, respectively, by its sliding movements within the valve bore 9*a*. Abutted against one axial end of the main valve body 9 is a first piston 10 of a larger diameter which is slidably fitted in the piston case 7, while the other axial end of the main valve body 9 is in abutting engagement with a second piston 11 of a smaller diameter which is slidably fitted in the piston case 8. A return chamber 12 which is defined behind the second piston 11 is communicated with the inlet port P through a return flow passage 13.

Figure 2:
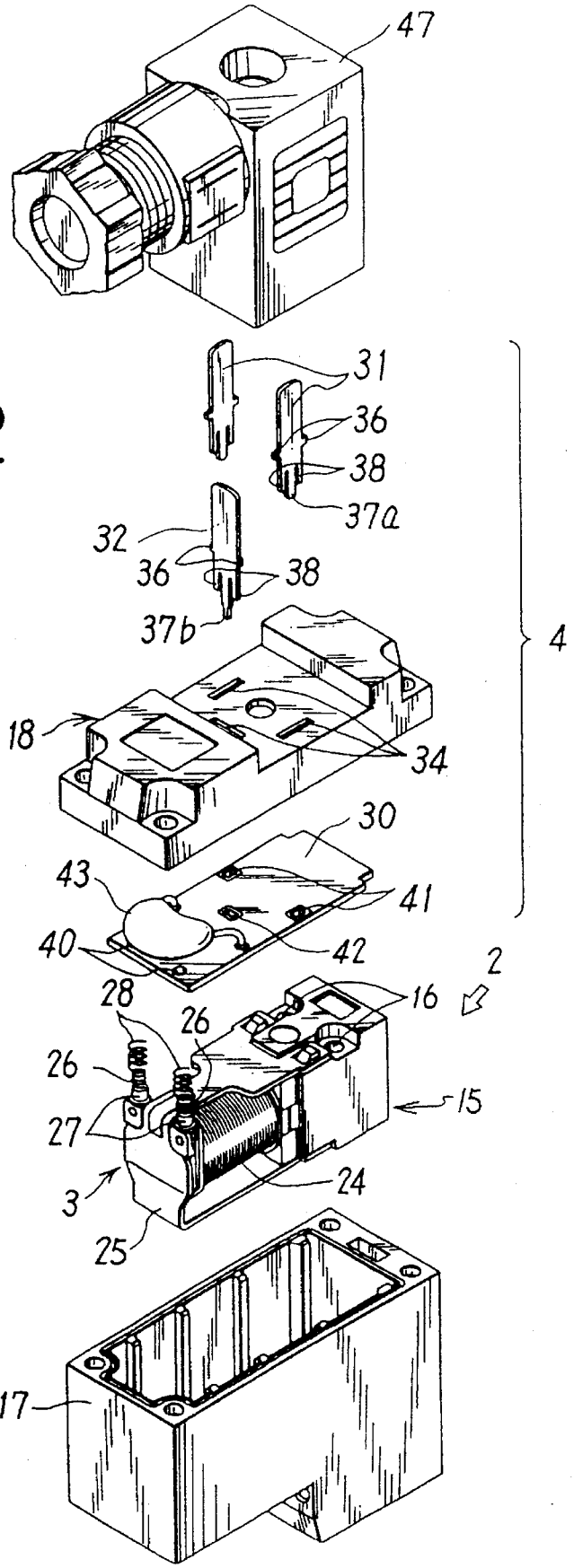
FIG. 2 is an exploded perspective view of major components of the electromagnetic valve shown in FIG. 1.
Figure 3:
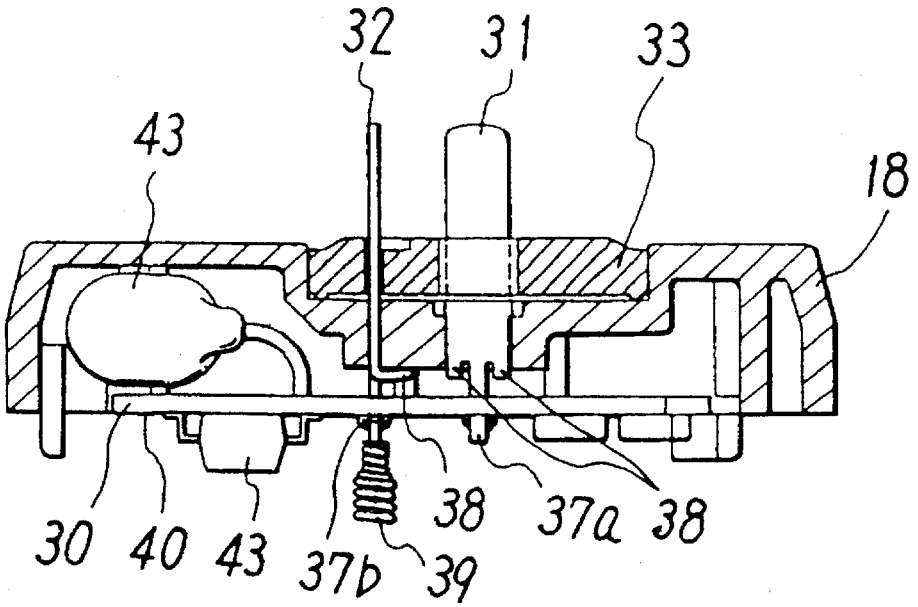
FIG. 3 is a sectional view illustrative of a manner of assembling a power supply section of the electromagnetic valve.
Figure 3:
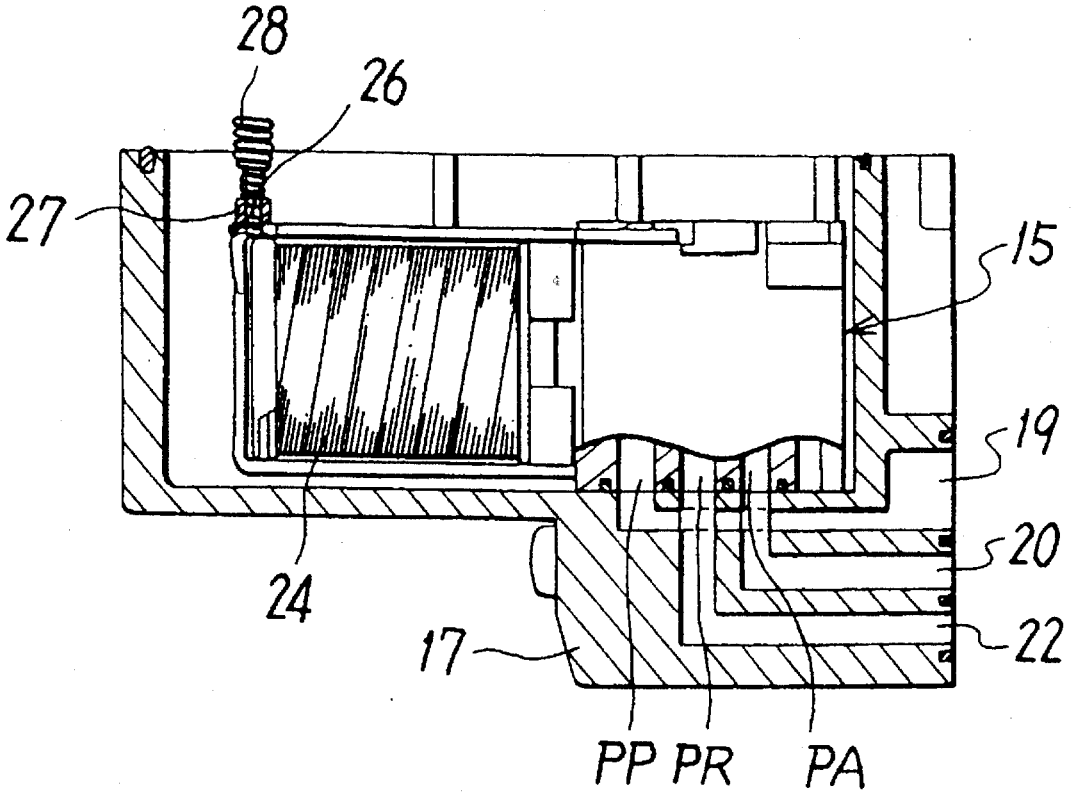

As seen in FIGS. 2 and 3, the pilot valve section 2 is arranged in the form of a known 3-port electromagnetic valve which selectively communicates a pilot output port PA in its change-over valve portion 15 either with a pilot inlet port PP or a pilot exhaust port PR upon energizing or de-energizing a coil 24 in its solenoid portion 3. This pilot valve assembly 2 is mounted in a pilot valve case 17 by a number of bolts (not shown) which are passed through mounting holes 16 in the above-mentioned switching portion 15. The pilot valve case 17 which is open on the upper side is mounted on the first piston case 7 of the main valve section 1 by suitable means.

The pilot inlet port PP is communicated with the inlet port P of the main valve section by a pilot supply passage 19 which is routed from the pilot valve case 17 through the first piston case 7 and the main valve casing 6. The pilot output port PA is communicated with a drive chamber 21 behind the first piston 10 through a pilot output passage 20 which is formed in the pilot valve case 17 and the first piston case 7. The pilot exhaust port PR is communicated with the outside through a pilot exhaust passage 22 which is provided in the pilot valve case 17 and the main valve casing 6.

The solenoid portion 3 of the pilot valve 2 is of known arrangements including a coil 24 wound on a bobbin (not shown), a magnetic frame 25 which covers the coil 24, and fixed and movable iron cores (both not shown). At one side of the solenoid portion 3, a pair of pin-shaped coil terminals 26 which are electrically connected to the above-mentioned coil 24 are projected above the magnetic frame 25, The coil terminals 26 have protective rubber tubes 27 fitted on the respective base portions and at the same time have conducting springs 28 fitted on the respective upper ends to serve as resilient contacts.

A terminal plate 18, which also serves as a lid to be fitted in an opening on the top side of the pilot valve case 17, includes a recess which is formed on the side of the pilot valve case 17 for mounting a printed wiring board 30, and terminal holes 34 which are arranged to receive loosely therein current receiving terminals 31 and a grounding terminal 32.

As shown in FIG. 2, the current receiving terminals 31 and grounding terminal 32 are each provided with stopper portions 36 which are formed at the opposite sides of a longitudinally intermediate portion of a strip-like body, a connecting portion 37*a* or 37*b* which is formed in a fore end portion to be passed through the terminal hole 34, and bending tab portions 38 which are formed at the opposite sides of the connecting portion. A grounding spring 39 in the form of a conducting coil spring is fitted on the connecting portion 37*b* of the grounding terminal 32.

The printed wiring board 30 which constitutes part of the power supply section 4 has an electrical power supply circuit printed on an electrically insulating substrate in a well-known manner, with necessary electrical and electronic parts 43 assembled into the power supply circuit for energization of the solenoid section 3. Formed in part of the power supply circuit are conducting portions 40 to be electrically connected to the coil terminals 31 through the resiliently contacting conducting springs 28, terminal connector holes 41 which engage with the current receiving terminals 31, and a terminal holder hole 42 which engages the grounding terminal 32.

A manual operation button 45 which is provided on the first piston case 7 is normally urged upward in the drawing by means of a spring 46 to open the pilot supply passage 19. When the manual button 45 is depressed, the pilot supply passage 19 is communicated directly with the drive chamber 21 without passing through the pilot valve section 2.

In the drawing, the reference numeral 47 denotes a feeder terminal box.

For assembling the pilot type electromagnetic valve of the above construction, firstly the pilot valve section 2 is assembled into the pilot valve case 17 which is mounted on the main valve section is prior to assembling the power supply section 4 in position on the pilot valve section.

Thereafter, the fore end portions of the current receiving terminals 31 and grounding terminal 32 are inserted into the respective terminal holes 34 in the terminal plate 18 until the stopper portions 36 are brought into abutting engagement with marginal edge portions of the terminal holes 34, and then the bending tab portions 38 are bent toward the terminal plate 18 to hold the respective terminals securely thereon.

Nextly, the connecting portions 37*a* of the current receiving terminals 31 and the connecting portion 37*b* of the grounding terminal 32 are respectively inserted into the terminal connector holes 41 and the terminal holder hole 42 of the printed wiring board 30 and electrically connected by soldering to the power supply circuit on the printed wiring board 30. By so doing, the printed wiring board 30 itself is simultaneously assembled with the terminal plate 18. The conductive grounding spring 39 is then fitted on the connecting portion 37*b* of the above-described grounding terminal 32.

The terminal plate 18, which has been assembled with the printed wiring board 30, is fixed on the pilot valve case 17 by means of mounting bolts (not shown), whereupon the conducting springs 28 on the coil terminals 26 are resiliently pressed against conducting portions 40 on the printed wiring board 30 to connect the power supply circuit with the coil 24 of the solenoid section 2. Simultaneously, the grounding spring 39 on the grounding terminal 32 is pressed against the magnetic frame 25.

Thus, the current supply from the current receiving terminals 31 to the coil 24 becomes feasible, and at the same time the solenoid section 2 is connected to the grounding terminal 32.

With the pilot type electromagnetic valve of the above-described construction, upon supplying current to the coil 24 of the pilot valve in the position shown in FIG. 1, the pilot input port PP is brought into communication with the pilot output port PA to supply the pilot fluid to the drive chamber 21. As a consequence, the main valve body 9 is moved to the right in the drawing, communicating the inlet port P with the output port A while communicating the output port B with the exhaust port EB. In this position, the output compressed air appears at the output port A.

Upon cutting off the current supply to the coil 24, the pilot output port PA is communicated with the pilot exhaust port PR to discharge the pilot air in the drive chamber 21 to the outside, whereupon the main valve body 9 is returned to the position shown in the drawing under the influence of the return fluid pressure prevailing in the return chamber 12, communicating the inlet port P with the output port B while communicating the output port A with the exhaust port EA. In this position, the output compressed air appears at the output port B.

Thus, since the printed wiring board 30 is assembled with the terminal plate 18, the pilot type electromagnetic valve of the above-described construction is exempted from the restrictions which would be imposed with regard to the manner of mounting the pilot valve section 2 on the pilot valve case 17 in case the printed wiring board 30 is supported on the pilot valve section 2. Besides, upon dismantling the terminal plate 18 from the pilot valve case 17, the printed wiring board 30 is removed simultaneously along with the terminal plate 18 to make the maintenance of the pilot valve section 2 easier. Further, the arrangement which electrically connects the coil terminals 26 to the printed wiring board 30 through the resiliently contacting conducting springs 28 contributes to precluding in a reliable manner the damage which might be caused to the coil terminals 26 by imposition of distorting or Straining forces at the time of mounting and dismantling the terminal plate 18 on and off the pilot valve case 17.

Moreover, the grounding terminal 32 is automatically connected to the solenoid section 3 through the grounding spring 39 upon mounting the terminal plate 18 in position on the pilot valve case. This makes it possible to ground the solenoid portion 3 without necessitating any machining operations especially for this purpose.

Obviously, numerous modifications and variations of the present invention are possible in light of the above teachings. It is therefore to be understood that within the scope of the appended claims, the invention may be practiced otherwise than as specifically described herein.

What is claimed is:

1. A pilot type electromagnetic valve, which comprises:

a main valve section incorporating a main valve body switching the flow direction of a main fluid, an electromagnetically operated pilot valve section switching the position of main valve body by the action of a pilot fluid pressure, and a power supply supplying current to said pilot valve section, wherein:

said pilot valve section comprises a pair of pin shaped coil terminals connected to a solenoid coil and accommodated in a projected state within a pilot valve case mounted on said main valve section, and conducting springs respectively fitted on and surrounding said coil terminals as resilient contacts; and said power supply comprises current receiving terminals mounted on a terminal plate which comprises a closure lid for said pilot valve case, and a printed wiring board supporting thereon an electrical power supply circuit and mounted on said terminal plate with said current receiving terminal and said power supply circuit in conductive state; said power supply circuit and coil terminals being electrically connected with each other through said conducting springs upon mounting said terminal plate on said pilot valve case.

2. A pilot type electromagnetic valve as defined in claim 1, wherein a grounding terminal is mounted on said terminal plate and said printed wiring board, and a grounding spring is fitted on a fore end portion of said grounding terminal in such a way that said grounding terminal is electrically connected to said pilot valve section through said grounding spring upon mounting said terminal plate on said pilot valve case.

* * * * *